United States Patent [19]

Miyashita et al.

[11] Patent Number: 4,504,306

[45] Date of Patent: Mar. 12, 1985

[54] METHOD OF PRODUCING AGGLOMERATES

[75] Inventors: Tsuneo Miyashita; Noboru Sakamoto; Hiroshi Fukuyo, all of Yokohama, Japan

[73] Assignee: Nippon Kokan Kabushiki Kaisha, Tokyo, Japan

[21] Appl. No.: 550,732

[22] Filed: Nov. 14, 1983

Related U.S. Application Data

[63] Continuation of Ser. No. 390,380, Jul. 8, 1982, abandoned.

[30] Foreign Application Priority Data

Jul. 10, 1981 [JP] Japan ..... 56-106869

[51] Int. Cl.[3] ..... C22B 1/04; C22B 1/20; C22B 1/242

[52] U.S. Cl. ..... 75/3; 75/4; 75/5; 23/313 P

[58] Field of Search ..... 75/3, 4, 5; 23/313 P

[56] References Cited

U.S. PATENT DOCUMENTS 2,805,141 9/1957 Apuli et al. ..... 75/3
2,860,598 11/1958 Loesche ..... 23/313 P
3,244,507 4/1966 Linney ..... 75/3

FOREIGN PATENT DOCUMENTS 55-107741 8/1980 Japan .
56-2134 1/1981 Japan .

*Primary Examiner*—Delbert E. Gantz
*Assistant Examiner*—Chung Pak
*Attorney, Agent, or Firm*—Fleit, Jacobson, Cohn & Price

[57] ABSTRACT

A method of producing agglomerates from a fine iron ore or the like having a wide particle size distribution. A solid fuel is added to the fine ore and the material is formed into pellets or briquettes of a two-layer structure comprising a core portion and a shell portion having different solid fuel contents, and the pellets or briquettes are charged onto a grate of a travelling grate-type furnace including an updraft drying zone, a downdraft drying zone, an ignition zone and a suction burning zone in such a manner that the charge having a higher solid fuel content forms a grate upper layer portion and the charge having a lower solid fuel content forms a grate lower layer portion, thereby firing the pellets or briquettes by the furnace.

5 Claims, 4 Drawing Figures

METHOD OF PRODUCING AGGLOMERATES

This application is a continuation of application Ser. No. 396,380, filed July 8, 1982 and now abandoned.

BACKGROUND OF THE INVENTION

The present invention relates to methods of producing agglomerated materials such as pellets or briquettes well suited for use as blast furnace charge and feed for iron making, and more particularly the invention relates to a method of producing agglomerates so designed that very fine materials having a wide distribution of particle sizes, e.g., fine iron ores unsuited for use with the conventional agglomerating processes such as sintering and pelletizing are formed, along with solid fuel, into pellets, briquettes or the like and the formed material is fired in a travelling grate-type furnace.

The present invention is intended to produce agglomerates having excellent economy and having excellent high-temperature properties as blast furnace charge and feed over those of the conventional processes from raw materials such as fine iron ores of the particle sizes which have been unsuited for use as raw materials.

It is well known in the art that generally there is a proper range of particle sizes for the fine ores used as raw materials in the production of sinters and pellets. With the DL-type sintering process, for example, the raw material is usually charged onto a grate without any formation. As a result, there is a requirement that the raw material fine ore should preferably include less than 10% (by weight) of the ore having the particle size of less than 125$\mu$ from the standpoint of ensuring the desired permeability. Also, since the product is subjected to crushing and sizing, the product yield is deteriorated and amounts to about 70%. In the case of the travelling grate-type pelletizing process, the fine iron ore must be formed into pellets by a preliminary processing operation. As a result, the particle size distribution of the raw material fine ore must be such that the ore contains 60 to 90% (by weight) of the material of less than 44$\mu$.so as to be formed into pellets smoothly. Also, the pellets are indurated by a burner above the grate using the down draft and the upper and lower layers of the pellets on the grate differ in heat pattern from each other thus causing variations in the product quality.

The agglomerate manufacturing method proposed in Japanese Laid-Open Patent Publication No. 55-107741 is similar in operation to the present invention in that it involves a preliminary heating operation prior to the ignition and it is still different from the subject matter of the invention in the following points thus making it impossible to obtain the effects of the present invention:

(i) The material is not a formed material (pellets or briquettes).

(ii) A high-coke layer having a coke content of over 30% (by weight) is formed in thickness ranging from 3 to 4 mm.

(iii) The preliminary heating operation involves only the downward gas flow.

Also, a preliminary treating method for fine sintering material is proposed in Japanese Patent Publication No. 56-2134 in which a portion of carbonaceous matter is added to the sintering material containing 15 to 35% (by weight) of fine iron ore of less than 125$\mu$ and the material is then subjected to a primary pellet forming operation. Then, the surface of the primary pellets are coated with the carbonaceous matter and converted to secondary pellets. The preliminary treating method then mixes the secondary pellets with 6 to 15% (by weight) of additional minipellets of which over 75% (by weight) has the particle size of 1 to 7 mm. As a result, this proposed process differs from the construction of the raw formed material according to the invention and hence the subject matter of the invention in that the surface of the pellets are coated only with the carbonaceous matter and that the coated pellets are further mixed with the minipellets.

SUMMARY OF THE INVENTION

With a view to realizing the processing and utilization of raw materials such as fine iron ores having a wide particle size distribution not suitable for producing either sinters or pellets and thereby producing from such raw materials agglomerates having excellent high-temperature properties for use in the blast furnace, it is the primary object of the present invention to provide an improved agglomerate production method comprising adding a fluxing material and a solid fuel such as powder coke, semicoke, powder coal or petroleum coke to a fine iron ore having the dominant particle size of less than 5 mm, forming the material into pellets or briquettes of 10 to 20 mm$\phi$, and firing the pellets or briquettes in a travelling grate-type furnace including updraft drying, downdraft drying, iginition and suction burning zones.

DESCRIPTION OF THE PREFERRED EMBODIMENT

Figure 1:
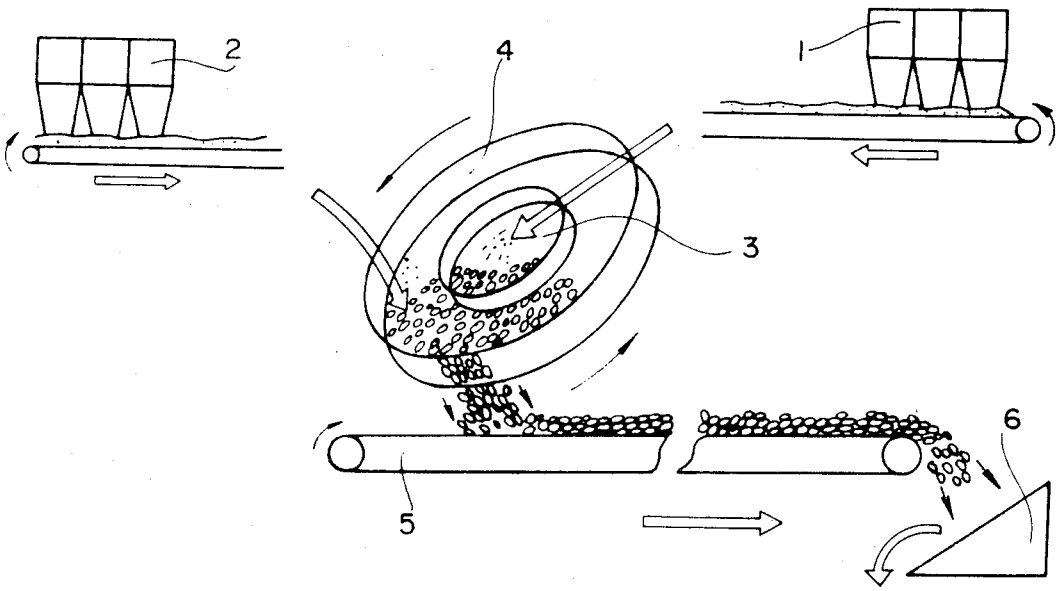
FIG. 1 is a perspective view showing a method of mixing a raw material such as fine iron ore and a solid fuel and forming the material into pellets of a two-layer structure having different solid fuel contents.

The present invention will now be described in greater detail with reference to the accompanying drawings.

The raw material fine iron ore used with the present invention will be described first. As regards the particle size of the ore, various ores having a wide particle size distribution are used, that is, the ordinary raw materials for sinter containing less than 10% (by weight) of under 125-$\mu$ material, the ordinary material ores for pellets containing more than 50% (by weight) of under 44-$\mu$ material, the fine ores having the intermediate particle size or the like.

The solid fuel used may be any of powdered coke, semicoke, pulverized coal, petroleum coke and charcoal and the particle size of the solid fuel should preferably be such that it contains more than 50% (by weight) of under 125-$\mu$ material. The fluxing material used may be comprised of an ordinary amount of lime or the like.

If the above-mentioned raw material is of relatively small particle size, the material is granulated and converted into pellets. If the material is of relatively large particle size, the material is formed and converted into briquettes. In forming, a fluxing material as well as a solid fuel and a binder are added and mixed with the fine ore in such a manner that the core and shell portions of the pellet or briquette have different solid fuel contents.

Also, in view of the objects of this invention and effective utilization of the waste heat it is preferable that the pellets or briquettes are formed into a two-layer-structure in which the core portion has a smaller solid fuel content and the shell portion has a greater solid fuel content or the formed material having a greater solid fuel content is charged onto the grate upper layer portion and the formed material having a smaller solid fuel content is charged onto the grate lower layer portion for the firing operation in the travelling grate-type furnace, that after the completion of the drying operation a carbonaceous matter of 0.1 to 5 mm in particle size is charged as a heat source into the surface portion of the upper layer formed charge or the waste heat of the suction burning zone is used as a heat source for the updraft drying and the downdraft drying and so on.

As a preferred example of the solid fuel additional contents, the core portion of the formed mass, e.g., pellet or briquette has a solid fuel additional content of 0.3 to 1.0% by weight of carbon and the shell portion has a solid fuel additional content of 1.0 to 4.5% by weight of carbon %. By so selecting, it is possible to produce a property improving effect during the firing operation. As regards the variations in the product quality, the variations can be reduced by charging the formed material onto the grate such that the grate upper layer portion has a greater solid fuel content and the grate lower layer portion has a smaller solid fuel content thereby providing different solid fuel contents.

The following Table 1 shows an example of the solid fuel additional contents by weight of carbon %.

TABLE 1

| Position | Formed mass shell portion (1-3 mm thick) | Formed mass core portion (5-15 mmØ) | Formed mass Average |
|---|---|---|---|
| Grate upper surface portion (200 mm) | 1.5-4.5% | 0.5-1.0% | 2-3% |
| Grate lower surface portion (500 mm) | 1.0-2.0% | 0.3-0.5% | 0.5-1.0% |

In accordance with the present invention, a pellet or briquette so formed that the core portion and the shell portion have different solid fuel contents is referred to as a two-layer pellet or two-layer briquette. Referring now to FIG. 1, the production process of two-layer pellets will be described. In the Figure, numeral 1 designates a storage tank containing a feed material having a solid fuel content of 0.3 to 1.0% by weight of carbon %, and 2 a storage tank containing a feed material having a solid fuel content of 1.0 to 4.5% by weight of carbon %. Numeral 3 designates a core pelletizer which is supplied with the feed material from the feed material storage tank 1. Numeral 4 designates a shell portion pelletizer which is supplied with the feed material from the feed material storage tank 2. Some binder is added in the pelletizer 3 and the resulting cores are formed with the surface or shell portions in the pelletizer 4. Numeral 5 designates a conveyor, and 6 a screen whereby the under sieve is returned to the feed material and the over sieve pellets passed through the screen 6 are fed to a lower layer pellet feeder 8 or an upper layer pellet feeder 9 of FIG. 2 in dependence on the solid fuel content. Numeral 7 designates a floor layer pellet feeder, 10 gates, 11 and 12 layer thickness adjusting plates which make reciprocal movements, 13 a cut-off plate, and 14 a grate which is driven to move in the direction of the arrow. While, in FIG. 1, a concentric circular two-stage pelletizer is used, two conical tray type or drum type pelletizers may be used in two stages to produce pellets of the two-layer structure.

Figure 3:
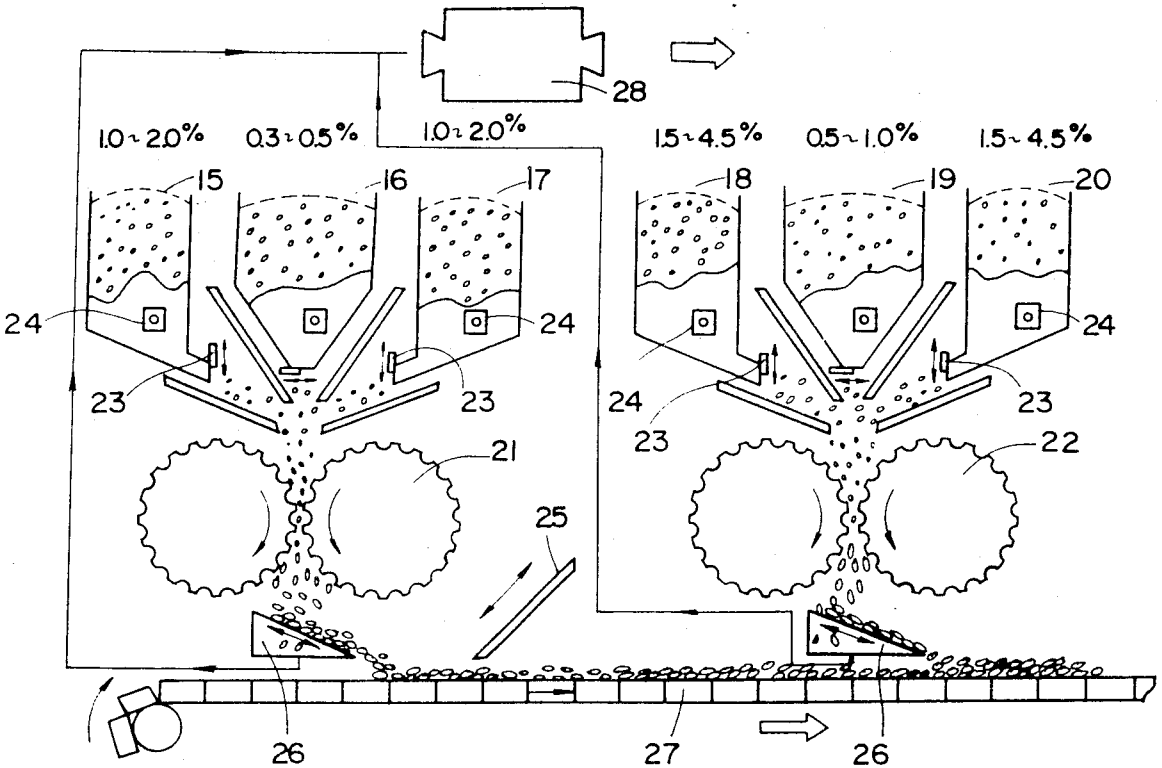
FIG. 3 is a sectional view showing a production method for converting a raw material such as fine iron ore and a solid fuel into two-layer briquettes and the charging of the briquettes in two layers onto a grate of a travelling grate-type furnace.

The method for producing two-layer briquettes and the method of charging the briquettes in two layers onto a grate will now be described with reference to FIG. 3.

In the Figure, numerals 15, 16 and 17 designate lower layer feed material storage tanks, and 18, 19 and 20 upper layer feed material storage tanks. The figures attached above each of these feed material storage tanks indicate the solid fuel content of the feed material by weight of carbon %. Numerals 21 and 22 designate roll-type briquetting machines. The briquetting machine 21 forms briquettes for the lower layer and the briquetting machine 22 forms the briquettes for the upper layer. Numeral 23 designates cut-off gates, and 24 vibrators. Numeral 25 designate a drive plate for adjusting the thickness of the layers on a grate, and 26 screens. Numeral 27 designates the grate which is driven to move in the direction of the arrow. Numeral 28 designates a crusher which receives the under sieve ore fines from the screens 26 crushes and returns the same to the material storage tank.

As described hereinabove, the raw materials, e.g., fine ore and fluxing agent are pelletized or briquetted, along with the solid fuel, to produce pellets or briquettes of the two-layer structure and they are then fired in a travelling grate-type furnace of the type shown in FIG. 4 so as to produce agglomerates well suited for use in the blast furnace.

Figure 2:
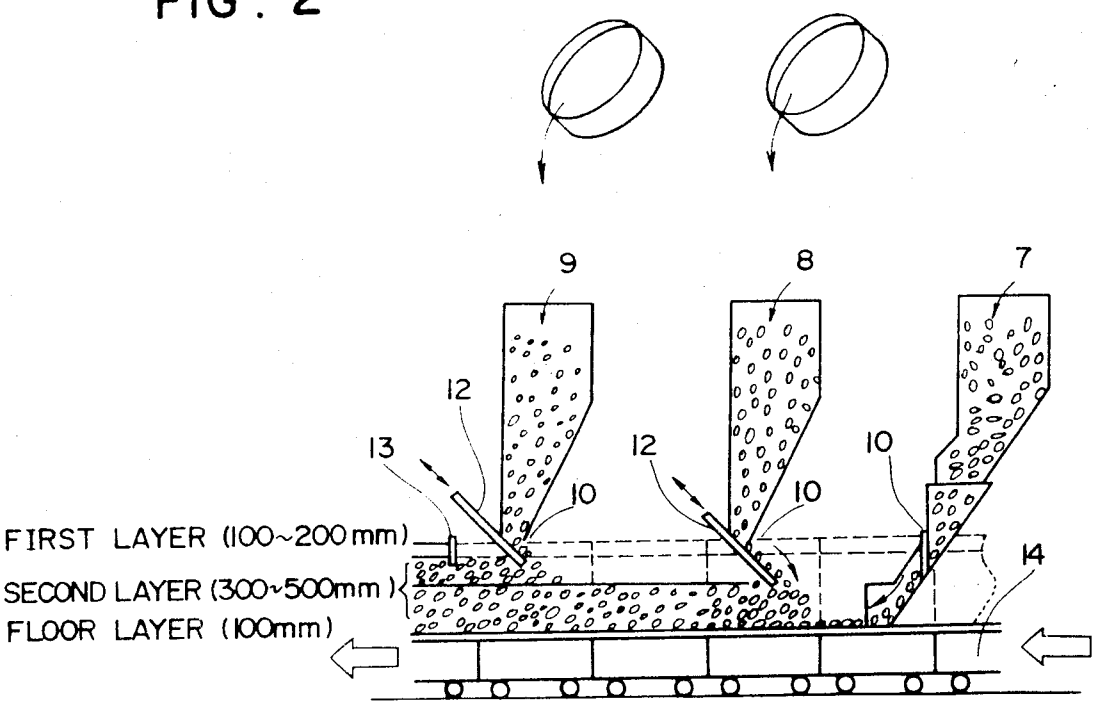
FIG. 2 is a sectional view showing a method of charging the two-layer pellets in two layers onto a grate of a grate-type furnace.
Figure 4:
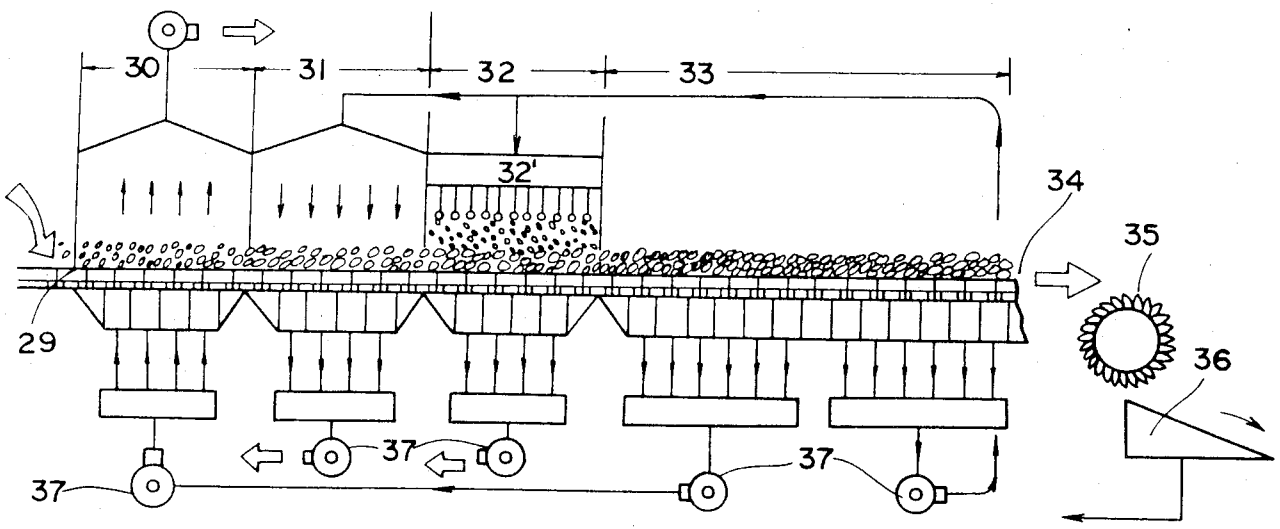
FIG. 4 is a flow diagram showing the construction of a travelling grate-type furnace used with the invention and the principal steps of its process.

In FIG. 4, numeral 29 designates a grate and the pellets or briquettes are charged onto the grate 29 at one end as shown by the arrow in the same manner as described in connection with FIGS. 2 or 3. Numeral 30 designates an updraft drying zone, and 31 a downdraft drying zone. In these zones, hot air or air is supplied in the directions of the arrows and the charged feed on the grate 29 is dried. Numeral 32 designates an ignition zone, and 32' an ignition furnace. In these zones, the charged feed on the grate 29 is ignited. Numeral 33 designates a firing and cooling zone where the fired and cooled agglomerates are automatically discharged from a product discharge 34 to a breaker 35 which in turn crushes the agglomerates to produce agglomerates of a specified particle size. The product agglomerates are passed to the following screen 36 and the over sieve material is delivered as the product. The under sieve material from the screen 36 is returned to a raw material hopper as return fines (the product particle size is 5 to 20 mm). Numeral 37 designates a blower.

In accordance with the present invention the particle diameter of pellets or briquettes should preferably be in the range between 10 and 20 mm for the reason that the particle size of less than 10 mm cannot attain the objects of the invention and the particle size of over 20 mm tends to cause bursting and heat shock during the firing. Differing from the ordinary sintering process, the drying zones are provided before the ignition zone for the reason of preventing the billets or briquettes from being powdered due to bursting and heat shock caused by the ignition. An example of the firing operating conditions is shown in the following Table 2.

TABLE 2

| Firing Conditions | | | |
|---|---|---|---|
| Zone | Temperature (°C.) | Differential pressure (mm $H_2O$) | Time (min.) |
| Updraft drying | 150–350 | 100–400 | 5–10 |
| Downdraft drying | 150–350 | 100–500 | 5–10 |
| Ignition | 1,000–1,300 | 400–1,000 | 0.5–3.0 |
| Firing, cooling | room temperature | 500–1,500 | 10–20 |

Also, to utilize the waste heat of the firing zone as a heat source for the updraft drying is effective in decreasing the fuel cost.

Examples and effects of the present invention will now be described.

EXAMPLE 1

The following Table 3 shows a comparison between the pellets produced by a hot grate furnace and incorporating a carbonaceous matter (semicoke) homogeneously and the pellets produced by the method according to the invention.

TABLE 3

| Example 1 (properties of fired pellets) | | |
|---|---|---|
| | (comparison example) Carbonaceous matter addition (2%) | (Invention) Carbonaceous matter shell portion 3% core portion 0.5% |
| *Porosity (%) | 38% | 36% |
| *Compressive strength (Kg/p) | 102 Kg/p | 220 Kg/p |
| *JIS reduction rate % | 75% | 82% |
| *Swelling index % | 24% | 8% |

$$*\text{Porosity (\%)}: \left(1 - \frac{\text{apparent specific gravity}}{\text{true specific gravity}}\right) \times 100,$$

according to the method stated in JIS 2151–1957.

*Compressive strength (Kg/p): More than 100 samples are subjected to a test in which the sample is stationarily placed at the center of the lower compressing table of a testing machine and a load is applied at a rate of 10 mm/min. The maximum value attained up to the complete breaking of the sample is the compressive strength. (JIS M 8718 (1976))

*JIS reduction rate (%): 500 g of samples (sized to 12 ± 1 mm) are reduced by a reducing gas having the composition $CO/N_2$ = 30/70 and the flow rate of 15 N l/min at 900° C. ± 10° C. for 180 minutes. The rate of reduction after the reduction is the JIS reduction rate. (JIS M 8713 (1977))

*Swelling index (%): Three samples having the particle size of over 5 mm are reduced by $CO/N_2$ = 30/70 of 500 Ml/min at 900° C. for 60 minutes and then the swelling index is measure according to $Sw = \frac{V_2 - V_1}{V_1} \times 100$ (SW = *swelling index %*, $V_1$ = volume (ml) before reduction and $V_2$ = volume (ml) after reduction. (JIS M 8715 (1977))

EXAMPLE 2

Table 4 shows a comparison between the pellets using semicoke as a carbonaceous matter and charged in parts onto the grate according to the method of this invention and the pellets charged honogeneously.

TABLE 4

| Example 2 (Examples of charging of pellets containing semicoke) | | | |
|---|---|---|---|
| | | (Comparative example) Homogeneous Charging | (Invention) Charging in Parts |
| Upper layer portion (200 mm) | | Shell 2.0% Core 0.5% | Shell 3.0% Core 0.5% |
| Lower layer portion (500 mm) | | Shell 2.0% Core 0.5% | Shell 1.0% Core 0.3% |
| Compressive strength | Upper layer | 85 Kg/p | 250 Kg/p |
| | Middle layer | 150 Kg/p | 240 Kg/p |
| | Lower layer | 240 Kg/p | 220 Kg/p |

EXAMPLE 3

Table 5 shows a comparison made on the briquettes under the same conditions as the Example 2.

TABLE 5

| Example 3 (Examples of charging of briquettes) | | | |
|---|---|---|---|
| | | (Comparative example) Homogeneous charging | (Invention) Charging in Parts |
| Upper layer | (200 mm thick) | shell 2.0% semicoke | shell 3.0 |
| | | core 0.5% semicoke | core 0.5 |
| Lower layer | (500 mm thick) | shell 2.0% semicoke | shell 1.0 |
| | | core 0.5% semicoke | core 0.3 |
| Compressive Strength | Upper layer | 110 Kg/p | 270 Kg/p |
| | Middle layer | 170 Kg/p | 240 Kg/p |
| | Lower layer | 270 Kg/p | 260 Kg/p |

EXAMPLE 4

The product is in the form of agglomerates or blocks of agglomerates. Thus, the yield of the product passed through the breaker and the screen is considerably improved as compared with the conventional sintering process. The sintered product yield according to the sintering process is 60 to 80% and the yield of the agglomerate product according to the invention is over 95%.

EXAMPLE 5

The conventional travelling grate-type pelletizing process uses an expensive heavy oil as the fuel for the burning zone. On the contrary, the agglomerating process according to the invention uses fuel only for the ignition source of the carbonaceous matter and moreover any substitute fuel other than the heavy oil (e.g., coal gas) may be used as the fuel. This decreases the producing cost.

EXAMPLE 6

Effective utilization of the heat energy is realized through the utilization of the waste heat of the suction burning zone as the drying hot air used in the updraft drying operation and the downdraft drying operation.

EXAMPLE 7

Powdered coke (containing 82% of under 125-μ size material) is selected as the carbonaceous matter and a fine ore (containing 63% of under 44-$\mu$ size material) having the composition of $SiO_2$=3.7%, $Al_2O_3$=1.6%, CaO=5.6% and $Fe_2O_3$=87.4% is formed according to the conditions of the Example 2 and burned by the process of this invention according to the conditions shown in the Table 2.

A comparison of the average properties of the product with the sinter product is shown in the following table.

| Item | Sinter | Agglomerate |
|---|---|---|
| $SiO_2$ (%) in product | 5.8% | 3.9% |
| Reduction rate under JIS conditions | 67.4% | 78.2% |
| *1 Shatter strength | 92% | 89% |
| *2 Reduction degradation index | 37.2% | 38.4% |

*1 Shatter strength (JIS M 8711 (1977) ): 20 Kg of 10–15 mm sinter are raised and dropped from the height of 2 m. This operation is performed four times and the entire samples are screened by a 10-mm sieve.

$S = \frac{A}{B} \times 100$, where S = shatter strength (%),

A = mass (Kg) of the sample of over 10 mm after the screening, and B = mass (Kg) of the sample before the test.

*2 Reduction degradation index (not standardized by JIS): A 500-g sample is reduced at 550° C. for 30 minutes by a reducing gas of $CO/N_2$ = 30/70 and 15 Nl/min. The material is cooled to the room temperature by an inert gas, is rotated in a rotating testing machine at 30 rpm for 30 minutes or 900 revolutions and is then screened by a 3-mm sieve. $RDI = \frac{W_3}{W_2} \times 100$, where RDI =

Reduction Degradation Index 3 mm index (%), $W_3$ = mass (g) of under 3-mm sample after screening, and $W_2$ = mass (g) of the sample charged into the rotary testing machine.

From the result of the comparison it is seen that while the RDI properties of the conventional sinter are deteriorated considerably if the $SiO_2$ content of the sinter is less than 5%, the RDI properties of the agglomerates produced by the process of this invention are maintained substantially the same as those of the sinter.

This is due to the fact that differing from the sinter, a fine iron ore is agglomerated and thus the bulk density of the agglomerates is increased thereby decreasing the content of $SiO_2$ which is the main constituent of the slag composition necessary for ensuring the strength before and after the reduction.

We claim:

1. A method of producing agglomerates well suited for use in an iron producing blast furnace from a fine iron ore as a principal raw material, comprising the steps of:

adding a fluxing material and a solid fuel to a fine iron ore having a dominant particle size of less than 5 mm;

forming said material into first and second groups of pellets or briquettes of a size between 10 and 20 mm$\phi$, wherein each of said pellets or briquettes of the first and second groups is formed into a two-layer structure, said two-layer structure consisting of a core portion containing 0.3 to 1.0% by weight carbon and a shell portion containing 1.0 and 4.5% by weight carbon and wherein each of said pellets or briquettes of said first group contains 2 to 3% by weight of carbon and each of said pellets or briquettes of said second group contains between 0.5 and 1.0% by weight carbon;

charging said first and second groups of pellets onto a travelling grate-type furnace in an upper layer and a lower layer, said upper layer consisting of said first group of pellets or briquettes and said lower layer consisting of said second group of pellets; and firing said pellets or briquettes in said travelling grate-type furnace including an updraft drying zone, a downdraft drying zone, an ignition zone and a suction burning zone.

2. A method according to claim 1, wherein said solid fuel is powdered coke, semicoke, pulverized coal, or petroleum coke.

3. A method according to claim 1, wherein said firing in said travelling grate-type furnace is effected by charging, after the end of a drying step, a carbonaceous matter of a particle size between 0.1 and 5 mm onto the surface of said upper layer charge as a heat source for said firing.

4. A method according to claim 1, wherein the waste heat of said suction burning zone is used as a heat source for said updraft drying and said downdraft drying.

5. The method of producing agglomerates according to claim 1 wherein said starting materials consisting of fine iron ores, fluxing materials and solid fuel are supplied to each of two pelletizing sections of a pan-type pelletizer while the binder is added, for producing pellet-like formed mass, said pan-type pelletizer having its pan divided into said two pelletizing sections, a circular central portion and a ring-like outer portion, characterized in that the content of the solid fuel in said starting materials is lower in the ring-like portion than in the central portion, thereby producing said pellets of double-layer structure with amounts of solid fuel in the core and shell portions being 0.3 to 1.0% and 1.0 to 4.5%, respectively.

* * * * *

UNITED STATES PATENT AND TRADEMARK OFFICE

CERTIFICATE OF CORRECTION

PATENT NO. : 4,504,306

DATED : March 12, 1985

INVENTOR(S) : T. Miyashita et al.

It is certified that error appears in the above-identified patent and that said Letters Patent is hereby corrected as shown below:

Column 8, line 10, change "1.0 and 4.5%" to --1.0 to 4.5%--.

Signed and Sealed this

Thirty-first Day of July, 1990

*Attest:*

HARRY F. MANBECK, JR.

*Attesting Officer*

*Commissioner of Patents and Trademarks*